US010327516B2

(12) United States Patent
Grimm

(10) Patent No.: US 10,327,516 B2
(45) Date of Patent: Jun. 25, 2019

(54) WEB-ADJUSTMENT HOUSING FOR A BUCKLE ASSEMBLY

(71) Applicant: ILLINOIS TOOL WORKS INC., Glenview, IL (US)

(72) Inventor: Michael B. Grimm, Evanston, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/391,724

(22) PCT Filed: Apr. 16, 2013

(86) PCT No.: PCT/US2013/036733

§ 371 (c)(1),
(2) Date: Oct. 10, 2014

(87) PCT Pub. No.: WO2013/158612

PCT Pub. Date: Oct. 24, 2013

(65) Prior Publication Data

US 2015/0074951 A1 Mar. 19, 2015

Related U.S. Application Data

(60) Provisional application No. 61/625,748, filed on Apr. 18, 2012.

(51) Int. Cl.

| | |
|---|---|
| ***A44B 11/04*** | (2006.01) |
| ***A44B 11/26*** | (2006.01) |
| ***A44B 11/00*** | (2006.01) |

(52) U.S. Cl.

CPC ..... *A44B 11/04* (2013.01); *A44B 11/006* (2013.01); *A44B 11/266* (2013.01); *Y10T 24/40* (2015.01); *Y10T 24/407* (2015.01)

(58) Field of Classification Search

CPC ..... A44B 11/04; A44B 11/266; A44B 11/006; Y10T 24/407; Y10T 24/40

See application file for complete search history.

(56) References Cited

U.S. PATENT DOCUMENTS 844,082 A * 2/1907 Barabasz ..... A44B 11/04 24/186

871,981 A * 11/1907 Blum ..... A44B 11/04 2/268

(Continued)

FOREIGN PATENT DOCUMENTS

WO 2012/162615 A2 11/2012

OTHER PUBLICATIONS

ISR and WO for PCT/US2013/036733 mailed Jul. 25, 2013.

*Primary Examiner* — Robert Sandy
*Assistant Examiner* — Louis A Mercado
(74) *Attorney, Agent, or Firm* — Quarles & Brady LLP

(57) ABSTRACT

A web-adjustment housing of a buckle member may include a receiving crossbar, a securing crossbar, and a strut. The receiving crossbar may include a ledge that extends in a first direction at a first angle with respect to a plane that contains or is parallel to a longitudinal axis, and first retaining members configured to securely engage webbing. The securing crossbar may include a surface that extends in a second direction at a second angle with respect to the plane, and second retaining members extending from the surface configured to securely engage the webbing. A receiving channel may be defined between the receiving crossbar and the securing crossbar. A release channel may be defined between the securing crossbar and the strut. The receiving channel and the release channel may define at least a portion of a web channel configured to adjustably retain the webbing.

16 Claims, 3 Drawing Sheets

(56) References Cited

U.S. PATENT DOCUMENTS

| | | | | | |
|---|---|---|---|---|---|
| 1,486,599 | A * | 3/1924 | Moore | A44B 11/10 | 24/194 |
| 4,171,555 | A * | 10/1979 | Bakker | A44B 11/04 | 24/200 |
| 4,662,040 | A * | 5/1987 | Terrell | A44B 11/266 | 24/615 |
| 4,800,629 | A * | 1/1989 | Ikeda | A44B 11/005 | 24/170 |
| 5,465,472 | A | 11/1995 | Matoba | | |
| 5,517,836 | A * | 5/1996 | Hong | A44B 11/266 | 70/30 |
| 5,590,444 | A * | 1/1997 | Krauss | A44B 11/266 | 24/625 |
| 7,296,327 | B2 | 11/2007 | Anderson et al. | | |
| 7,302,742 | B2 | 12/2007 | Pontaoe | | |
| 7,331,088 | B2 | 2/2008 | Pontaoe | | |
| 2003/0014851 | A1* | 1/2003 | Murai | A44B 11/266 | 24/615 |
| 2007/0089280 | A1 | 4/2007 | Pontaoe | | |
| 2008/0078069 | A1 | 4/2008 | Pontaoe | | |
| 2008/0222860 | A1 | 9/2008 | Pontaoe | | |
| 2009/0100652 | A1* | 4/2009 | Mok | A44B 11/266 | 24/625 |
| 2010/0186198 | A1* | 7/2010 | Morhain | A01K 27/007 | 24/163 K |
| 2014/0096348 | A1 | 4/2014 | Anderson et al. | | |

* cited by examiner

WEB-ADJUSTMENT HOUSING FOR A BUCKLE ASSEMBLY

RELATED APPLICATIONS

The present application is a National Phase of International Application Number PCT/US2013/036733 filed Apr. 16, 2013 and relates to and claims priority benefits from U.S. Provisional Patent Application No. 61/625,748 filed Apr. 18, 2012, which is hereby incorporated by reference in its entirety.

FIELD OF EMBODIMENTS OF THE DISCLOSURE

Embodiments of the present disclosure generally relate to a buckle assembly, and, more particularly, to a buckle assembly having a web-adjustment housing that defines a web channel.

BACKGROUND

Buckles are used to securely connect components together. For example, various bags, backpacks, and the like have male and female buckle members connected to straps, webbing, or the like. Each strap, for example, is looped through a web channel on a buckle member. In order to connect the looped straps together, the make buckle member is connected to the female buckle member.

A conventional side-release buckle assembly may include a male connection member that is configured to mate with a female connection member, such as shown and described in U.S. Pat. No. 5,465,472, entitled "Buckle." Each connection member is configured to retain a strap, such as a seatbelt or backpack strap. The male connection member includes integral buttons that may be engaged to release the male connection member from the female connection member, thereby disconnecting the buckle assembly.

The male connection member may include a pair of flexible lateral arms having buttons at distal ends. A rigid strut member may extend between the lateral arms. A strap receiving channel may be formed through the male connection member between the rigid strut member and a strap bar.

In general, buckle members have strap-receiving or web channels that are configured to restrict the movement of webbing therethrough. While an individual may adjust the strap or channel within the web channel, the buckle member typically restricts the movement, so that the web or strap within the web channel remains at a desired length. In order to secure the strap or webbing in position, many individuals double and triple loop portions of the webbing or strap within the web channel.

Some buckle members include numerous small teeth that bite into the webbing or strap. The teeth dig into the material of the webbing or strap, in order to securely retain the webbing or strap at a desired position.

However, buckle members typically have relatively small web channels that may be difficult for an individual to navigate webbing therethrough. As such, the web channels of certain buckle members may be difficult for an individual to move a strap or webbing therethrough in order to adjust a length of the webbing or strap. Further, many known buckle member have web channels that may damage the webbing. As an example, the small teeth of certain buckle members may snag and tear webbing or strap material.

SUMMARY OF EMBODIMENTS OF THE DISCLOSURE

Certain embodiments of the present disclosure provide a buckle member of a buckle assembly. The buckle member may include a mating interface and a web-adjustment housing connected to the mating interface. The web-adjustment housing may include opposed lateral walls, a receiving crossbar, a securing crossbar, and a strut. The receiving crossbar may extend between the opposed lateral walls, and include a ledge that extends in a first direction at a first angle with respect to a plane that contains or is parallel to a longitudinal axis. The securing crossbar may also extend between the opposed lateral walls. A receiving channel may be defined between the receiving crossbar and the securing crossbar. The securing crossbar may include a surface that extends in a second direction at a second angle with respect to the plane. One or both of the receiving crossbar and the securing crossbar may also include one or more retaining members configured to securely engage webbing. The strut may also extend between the opposed lateral walls. A release channel may be defined between the securing crossbar and the strut. The receiving channel and the release channel may define at least a portion of a web channel configured to adjustably retain the webbing.

The securing crossbar may also include an apex. The receiving channel may connect to the release channel proximate to the apex.

Each retaining member may include an angled surface that is parallel to the ledge. Each retaining member may have a width that is between ⅕ and ½ a width of a receiving channel of the web-adjustment housing.

The first angle may be 45° from the ledge to the plane. The second angle may be between 45° and 90° from the surface to the plane.

The mating interface may include lateral arms and a guide beam configured to be secured into a reciprocal interface of a female buckle member. Optionally, the mating interface may include a reciprocal interface configured to receive lateral arms and a guide beam of a male buckle member.

Figure 1:
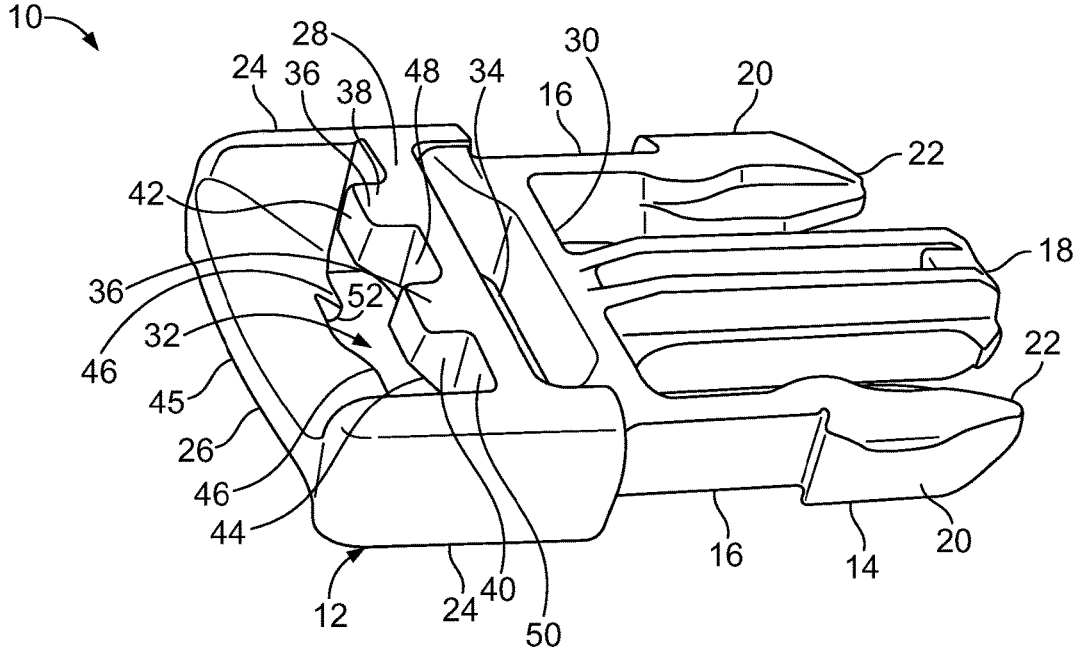
FIG. 1 illustrates an isometric top view of a buckle member, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

FIG. 1 illustrates an isometric top view of a buckle member 10, according to an embodiment of the present disclosure. The buckle member 10 may be molded and formed as a unitary piece of material. For example, the buckle member 10 may be an integral piece of injection-molded plastic or metal.

The buckle member 10 includes a web-adjustment housing 12 integrally connected to a mating interface 14. It is to be understood that the terms web or webbing refer to webbing, straps, ropes, strings, fabric, sheets, or the like that are configured to be adjustably secured within the web-adjustment housing 12. The mating interface 14 is configured to securely mate with a reciprocal interface of a counterpart buckle member. The buckle member 10 shown in FIG. 1 is a male buckle member having opposed flexible lateral arms 16 with one or more guide beams 18 disposed therebetween. Engagement buttons 20 may be formed proximate to distal ends 22 of the lateral arms 16. While the buckle member 10 is shown as a male buckle member, the buckle member 10 may be a female buckle member configured to mate with a male buckle member. In short, the web adjustment housing 12 may be used with male and female buckle members. Indeed, embodiments of the present invention may be used with respect to any of the buckle members shown and described, for example, in U.S. Pat. No. 7,331,088, entitled "Buckle Assembly," U.S. Pat. No. 7,296,327, entitled "Buckle Assembly," U.S. Pat. No. 7,302,742, entitled "Side Release Buckle Assembly," PCT Publication WO2012/162615, entitled "Buckle Assembly," United States Patent Application Publication No. 2007/0089280, entitled "Side Release Buckle Assembly," United States Patent Application Publication No. 2008/0222860, entitled "Buckle Assembly," and United States Patent Application Publication No. 2008/0078069, entitled "Strap Adjusting Assembly," all of which are hereby incorporated by reference in their entireties.

The web-adjustment housing 12 includes opposed lateral walls 24. A receiving crossbar or crossbeam 26, a securing crossbar or crossbeam 28, and a strut 30 extend between the opposed lateral walls 24. Each of the receiving crossbar 26, the securing crossbar 28, and the strut 30 may be perpendicular to the opposed lateral walls 24. However, the receiving crossbar 26, the securing crossbar 28, and the strut 30 may span between the opposed lateral walls 24 at various angles, curves, slopes, or the like.

The mating interface 14 extends longitudinally outward from the strut 30. As shown in FIG. 1, the lateral arms 16 and the guide beam 18 may longitudinally extend outward from the strut 30.

A receiving channel 32 is defined between the receiving crossbar 26 and the securing crossbar 28. An adjustment channel 34 is defined between the securing crossbar 28 and the strut 30. The receiving channel 32 and the adjustment channel 34 may be configured to adjustably retain a portion of webbing. However, the adjustment channel 34 may not affect webbing retention. Instead, the adjustment channel 34 may be a pass-through channel.

The securing crossbar 28 may include one or more retaining members 36, such as block, teeth, barbs, clasps, or the like, extending into the receiving channel 32 toward the receiving crossbar 26. As shown in FIG. 1, two retaining members 36 extend from the securing crossbar 28.

Each retaining member 36 may include a rectangular top wall 38 connected to planar lateral walls 40 and a planar front wall 42. A bottom wall 44 of each retaining member 36 may angle downwardly from the front wall 42. The angle of the bottom wall 44 may be parallel to a plane of an angled ledge of the receiving crossbar 26.

The receiving crossbar 26 may also angle downwardly from a receiving end 45 into the receiving channel 32. The receiving crossbar 26 may also include one or more retaining members 46.

The retaining members 36 may be spaced apart from one another by a central gap 48. Further, each retaining member 36 may be spaced from a respective lateral wall 24 by a gap 50. Alternatively, the retaining members 36 may extend from the lateral walls 24.

Similarly, the retaining members 46 may be spaced apart from one another by a central gap 52. As shown in FIG. 1, the retaining members 46 may extend from respective lateral walls 24. However, the retaining members 46 may alternatively be separated from the lateral walls 24 by gaps.

Figure 2:
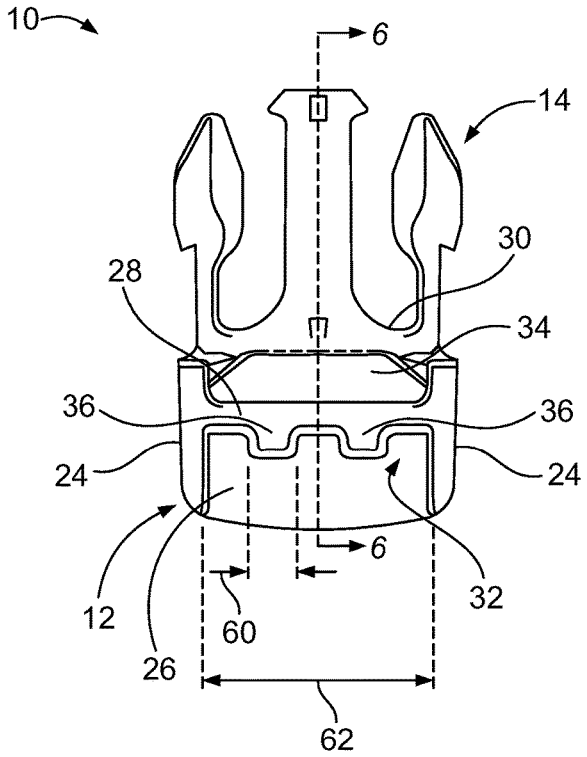
FIG. 2 illustrates a top view of a buckle member, according to an embodiment of the present disclosure.

FIG. 2 illustrates a top view of the buckle member, according to an embodiment of the present disclosure. Each retaining member 36 or 46 may have a width 60 that is a fraction of the width 62 of the receiving channel 32. For example, the width 60 of each retaining member 36 may be ⅕-⅓ the width 62 of the receiving channel 32. However, the widths may be greater or less than ⅕-⅓ the width 62. For example, instead of multiple retaining members 36 or 46, a single centrally located retaining member having ½ the width of the receiving channel 32 may be used. The relatively large size of each retaining member 36 or 46 ensures that the retaining members 36 or 46 do not snag or cut into web material, in contrast to smaller teeth that may dig, snag, and cut into web material. Yet, the retaining members 36 or 46 securely engage the web material.

Figure 3:
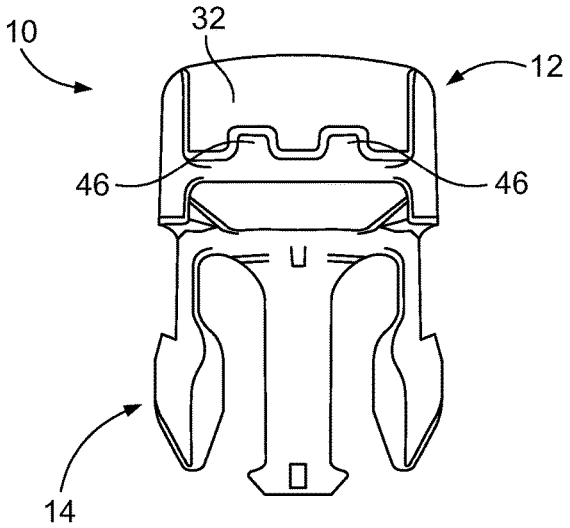
FIG. 3 illustrates a bottom view of a buckle member, according to an embodiment of the present disclosure.
Figure 4:
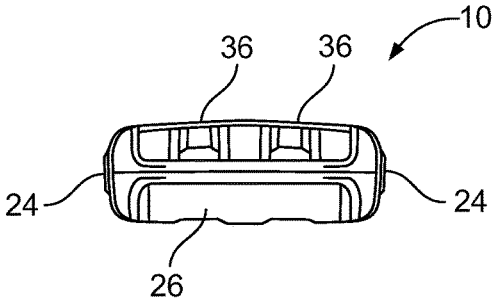
FIG. 4 illustrates an end view of a web-adjustment housing of a buckle member, according to an embodiment of the present disclosure.
Figure 5:
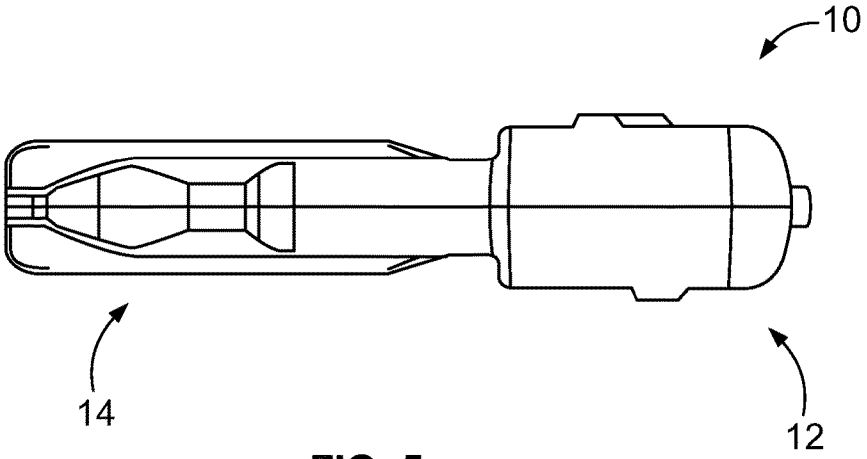
FIG. 5 illustrates a lateral view of a buckle member, according to an embodiment of the present disclosure.

FIG. 3 illustrates a bottom view of the buckle member 10, while FIG. 4 illustrates an end view of the web-adjustment housing 12 of the buckle member 10, and FIG. 5 illustrates a lateral view of the buckle member 10. As shown in FIG. 3, for example, the retaining members 46 may be separated from the lateral walls 24.

Figure 6:
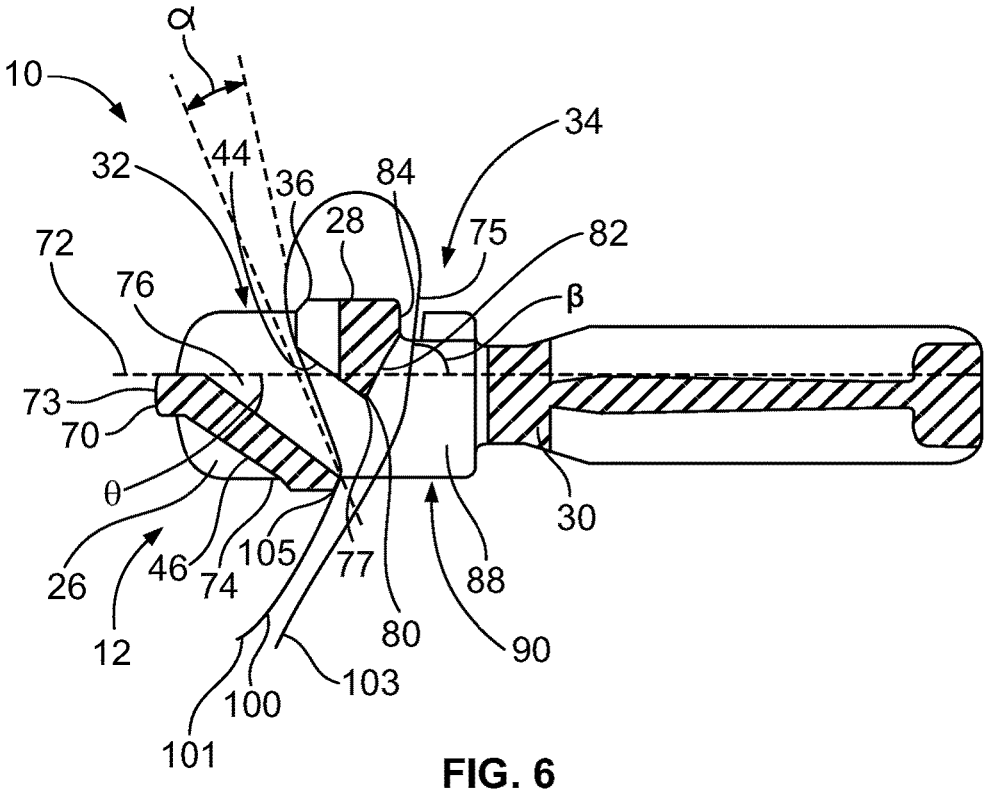
FIG. 6 illustrates a cross-sectional view of a buckle member through line 6-6 of FIG. 2, according to an embodiment of the present disclosure.

FIG. 6 illustrates a cross-sectional view of the buckle member 10 through line 6-6 of FIG. 2, according to an embodiment of the present disclosure. As shown in FIG. 6, the receiving crossbar 26 may include a planar lip 70 that is generally parallel with a longitudinal axis 72 of the buckle member 10. The planar lip 70 integrally connects to an angled ledge 74 that angles downwardly from the planar lip 70. The ledge 74 may be offset from the longitudinal axis 72 at an angle θ, which may be approximately 45°, for example. However, the angle θ may be greater or less than 45°, but is generally not longitudinally aligned with the planar lip 70 or parallel with the longitudinal axis 72. Similarly, the bottom wall 44 of each retaining member 36, as well as a bottom leading edge 77 of the securing crossbar 28 may be parallel with the ledge 74. A receiving inlet 76 is defined between an upper surface of the receiving crossbar 26 and a bottom surface of the securing crossbar 28.

As shown in FIG. 6, the bottom leading edge 77 of the securing strip 28 may terminate at an apex 80. An upwardly angled trailing surface 82 extends from the apex 80 toward a flat rear wall 84 of the securing crossbar 28. The angle β of the surface 82 may be 45°-75°, for example, from the surface of the surface 82 to the longitudinal axis 72. However, the angle β may be greater or less than 45°-75° from the surface of the surface 82 to the longitudinal axis 72. In general, the angle β is oppositely oriented from the angle θ. A release channel 88 is defined between the surface 82 and an internal surface of the strut 30.

The angled ledge 74 and the trailing surface 82 may extend in opposite directions with respect to a plane that is parallel to another plane that contains the longitudinal axis 72. For example, the angled ledge 74 may extend downwardly with respect to the plane that is parallel to the other plane that contains the longitudinal axis 72, while the trailing surface 82 extends upwardly with respect to the plane that is parallel to the other plane. In an embodiment, one or both of the angled ledge 74 and the trailing surface 82 may extend from locations relative to a plane that contains the longitudinal axis 72 or a parallel plane. The receiving inlet 76 may have an open receiving end at a receiving end 73 of the housing 12, while the release channel 88 may be part of the adjustment channel 34, which may have an open end 75 proximate to a top portion of the housing 12. The receiving inlet 76 and the release channel 88 may meet at the apex 80.

A web-channel 90 includes the receiving inlet 76 and the release channel 88. The web-channel 90 provides an undercut path through the web-adjustment housing 12. The angled nature of the receiving inlet 76 and the release channel 88 provides a circuitous path for webbing 100 to pass through. For example, as shown, the webbing 100 includes a free end 101 and a restrained end 103. The restrained end 103 may be restrained or attached to an object, such as a backpack, belt, or the like, while the free end 101 may be free and non-restrained. The webbing 100 may be looped through the securing crossbar 28 such that a portion of the webbing 100 is secured at a bite point 105 formed at a lower edge of the planar lip 70. The circuitous path provides increased retaining ability, as the webbing 100 wraps through angled portions. The webbing 100 is held tight against the bite point 105 and against the retaining members 36 and 46 at a backangle α. The tooth design interaction of the retaining members 36 and 46, such as the bite point 105, provides a simulated undercut. The opposite orientation of the angles β and θ, which may be opposite in one or both of direction and magnitude, provides a locking effect when force is applied to the webbing, such as through the weight of a component secured to the buckle member 10. The angle β provides a release angle that is greater than previous buckles because of the simulated undercut defined by the retaining members 36 and 46. Further, the bite point 105 may dig into the webbing 100, which provides added securing force into the webbing 100. Moreover, the retaining members 36 and 46 (shown in FIGS. 1-6) also securely engage the webbing 100, thereby securing the webbing 100 in place with respect to the web-adjustment housing 12. As explained above, the retaining members 36 and 46 are large enough to prevent or otherwise reduce the potential for damage to the material of the webbing 100.

The retaining members 36 and 46 formed on the securing crossbar 28 and the receiving crossbar 26, respectively, provide stepped areas that define high points, in relation to the gaps, which define low points. The retaining members 36 and 46 restrict movement of the webbing 100 through the web channel 90. As such, the channel 32 may be relatively tall, as the retaining members 36 and 46 provide retaining force within the receiving inlet 76. Without the retaining members 36 and 46, the channel 32 may be constricted (that is, shorter in height) in order to securely restrict and retain the webbing 100 in place. The retaining members 36 and 46 provide additional bite points that the webbing 100 distorts around, further providing a retaining force that locks the webbing 100 in place. The bite points, such as the bite point 105, are large enough to provide firm locking points without causing damage to the webbing 100 (in contrast to standard, small locking teeth). Additionally, because the retaining members 36 and 46 are relatively large (in comparison to standard locking teeth), they are firmly and robustly planted on the buckle member 10, and are not susceptible to breaking away from the housing 12.

As shown, the retaining members 36 and 46 extend into the receiving inlet 76, but may not extend into the release channel 88. Accordingly, the release channel 88 may be relatively unobstructed, whereas the retaining members 36 and 46 provide locking features that extend into the receiving inlet 76. In this manner, when an individual desires to adjust the webbing 100, the unobstructed, relatively large gap of the channel 32 allows for quick and easy adjustment, while the circuitous path of the web channel 90 and the retaining members 36 and 46 that extend into the receiving inlet 76 securely retain the webbing 100 in place after the individual has adjusted the webbing.

While the buckle member 10 is described having both the retaining members 36 and 46, the buckle member 10 may alternatively include only the retaining members 36 or 46. Further, while the buckle member 10 is shown having two retaining members 36 and two retaining members 46, more or less retaining members 36 and 46 may be used.

Additionally, because the web channel 90 is relatively tall (that is, the distance between the receiving crossbar 26 and the securing crossbar 28 is generally greater than known buckle assemblies), the webbing 100 may be more easily adjusted when engaged by an individual. Additionally, the angle β defines an angle of release for adjustment. The angle β may generally be greater than the angle θ, and provides a relatively high angle of release, which allows for easier adjustment through the web channel 90 when desired, and the webbing 100 is engaged by an individual for adjustment.

Embodiments of the present disclosure provide a buckle member having a web-adjustment housing that defines a web channel that provides a circuitous path that is configured to securely lock webbing in place. The web channel may be undercut through the housing, and the retaining members provide additional retaining force that is exerted into the webbing. The retaining members allow the web channel to be large enough to allow the webbing to be doubled and tripled over therein.

In contrast to known buckle members, embodiments of the present disclosure provide an increased height web channel, a web channel that is circuitous, which provides retaining strength, retaining members that provide additional retaining strength, and a high angle of release, which allows the webbing to be easily adjusted within the web channel.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

Various features of the disclosure are set forth in the following claims.

The invention claimed is:

1. A web-adjustment housing of a buckle member, the web-adjustment housing connected to a mating interface for mating with another mating interface of another buckle member, the web-adjustment housing comprising:

a receiving crossbar including: (a) a ledge that extends in a first direction at a first angle with respect to a plane that contains or is parallel to a longitudinal axis of the buckle member, and (b) first retaining members configured to securely engage webbing;

a securing crossbar including: (a) a surface that extends in a second direction at a second angle with respect to the plane, and (b) second retaining members extending from the surface configured to securely engage the webbing, wherein the first direction and the second direction are nonparallel, wherein a receiving channel is defined between the receiving crossbar and the securing crossbar, wherein one or both of the first or second retaining members have a width that is between ⅕ and ½ a width of the receiving channel of the web-adjustment housing; and a strut, wherein a release channel is defined between the securing crossbar and the strut, and wherein the receiving channel and the release channel define at least a portion of a web channel configured to adjustably retain the webbing.

2. The web-adjustment housing of claim 1, wherein the securing crossbar further comprises an apex, and wherein the receiving channel connects to the release channel proximate to the apex.

3. The web-adjustment housing of claim 1, wherein one or both of the first and second retaining members comprise an angled surface that is parallel to the ledge.

4. The web-adjustment housing of claim 1, wherein the first angle is 45° from the ledge to the plane and the second angle is between 45° and 90° from the surface to the plane.

5. A buckle member of a buckle assembly, the buckle member comprising:

a mating interface for mating with another mating interface of another buckle member; and a web-adjustment housing connected to the mating interface, wherein the web-adjustment housing comprises:

opposed laterals walls;

a receiving crossbar extending between the opposed lateral walls, wherein the receiving crossbar includes a ledge that extends in a first direction at a first angle with respect to a plane that contains or is parallel to a longitudinal axis of the buckle member;

a securing crossbar extending between the opposed lateral walls, wherein a receiving channel is defined between the receiving crossbar and the securing crossbar, wherein the securing crossbar includes an apex and a surface that extends in a second direction at a second angle with respect to the plane;

a plurality of first retaining members extending from the receiving crossbar into the receiving channel towards the securing crossbar;

a plurality of second retaining members extending from the securing crossbar into the receiving channel towards the receiving crossbar, wherein each of the plurality of first retaining members and the plurality of second retaining members comprises an angled surface that is parallel to the ledge; and a strut extending between the opposed lateral walls, wherein a release channel is defined between the securing crossbar and the strut, wherein the receiving channel and the release channel define at least a portion of a web channel configured to adjustably retain webbing, and wherein the receiving channel connects to the release channel proximate to the apex.

6. The buckle member of claim 5, wherein the first and second retaining members have a width that is between ⅕ and ½ a width of the receiving channel of the web-adjustment housing.

7. The buckle member of claim 5, wherein the first angle is 45° from the ledge to the plane and the second angle is between 45° and 90° from the surface to the plane.

8. The buckle member of claim 5, wherein the mating interface comprises lateral arms and a guide beam configured to be secured into the other interface of the other buckle member, wherein the other interface and the other buckle member is being a reciprocal interface of a female buckle member.

9. The buckle member of claim 5, wherein the buckle member is configured to receive lateral arms and a guide beam of the another buckle member.

10. A web-adjustment housing of a buckle member, the web-adjustment housing connected to a mating interface for mating with another mating interface of another buckle member, the web-adjustment housing comprising:

opposed laterals walls;

a receiving crossbar extending between the opposed lateral walls, wherein the receiving crossbar includes a ledge that extends in a first direction at a first angle with respect to a plane that contains or is parallel to a longitudinal axis of the buckle member;

a securing crossbar extending between the opposed lateral walls, wherein a receiving channel is defined between the receiving crossbar and the securing crossbar, wherein the securing crossbar includes a surface that extends in a second direction at a second angle with respect to the plane, wherein the first direction and the second direction are nonparallel;

a first retaining member extending from the receiving crossbar into the receiving channel towards the securing crossbar; and a second retaining member extending from the securing crossbar into the receiving channel towards the receiving crossbar, wherein the first and second retaining members have a width that is between ⅕ and ½ a width of the receiving channel of the web-adjustment housing.

11. The web-adjustment housing of claim 10, further comprising a strut extending between the opposed lateral walls, wherein a release channel is defined between the securing crossbar and the strut, and wherein the receiving channel and the release channel define at least a portion of a web channel configured to adjustably retain webbing.

12. The web-adjustment housing of claim 10, wherein the securing crossbar further comprises an apex, and wherein the receiving channel connects to a release channel proximate to the apex.

13. The web-adjustment housing of claim 10, wherein each of the first and second retaining members comprises an angled surface that is parallel to the ledge.

14. The web-adjustment housing of claim 10, wherein the first angle is 45° from the ledge to the plane and the second angle is between 45° and 90° from the surface to the plane.

15. A web-adjustment housing of a buckle member, the web-adjustment housing connected to a mating interface for mating with another mating interface of another buckle member, the web-adjustment housing comprising:

opposed laterals walls;

a receiving crossbar extending between the opposed lateral walls, wherein the receiving crossbar includes a ledge that extends in a first direction at a first angle with respect to a plane that contains or is parallel to a longitudinal axis of the buckle member; and a securing crossbar extending between the opposed lateral walls, wherein a receiving channel is defined between the receiving crossbar and the securing crossbar, wherein the securing crossbar includes a surface that extends in a second direction at a second angle with respect to the plane, wherein the first direction and the second direction are nonparallel, wherein one or both of the receiving crossbar and the securing crossbar further includes one or more retaining members extending into the receiving channel and configured to securely engage webbing, wherein the one or more retaining members have a width that is between ⅕ and ½ a width of the receiving channel of the web-adjustment housing.

16. The web-adjustment housing of claim 15, wherein the one or more retaining members comprise an angled surface that is parallel to the ledge.

* * * * *